United States Patent [19]

Grimm et al.

[11] Patent Number: 4,962,796

[45] Date of Patent: Oct. 16, 1990

[54] WEFT BRAKE WITH DAMPING CONTROL

[75] Inventors: Peter Grimm, Ruti; Willam Manfred, Galgenen, both of Switzerland

[73] Assignee: Sulzer Brothers Limited, Winterthur, Switzerland

[21] Appl. No.: 398,771

[22] Filed: Aug. 25, 1989

[30] Foreign Application Priority Data

Aug. 25, 1988 [CH] Switzerland ..... 03169/88

[51] Int. Cl.[5] ..... D03D 47/34

[52] U.S. Cl. ..... 139/450; 139/194

[58] Field of Search ..... 139/435.1, 450, 194

[56] References Cited

U.S. PATENT DOCUMENTS

| | | | |
|---|---|---|---|
| 3,540,492 | 11/1970 | Houwing | 139/450 |
| 4,290,461 | 9/1981 | Griffith | 139/450 |
| 4,513,792 | 4/1985 | Lincke | 139/450 X |
| 4,641,688 | 2/1987 | Gehring | 139/450 |
| 4,722,370 | 2/1988 | Manders | 139/435 |
| 4,817,681 | 4/1989 | Krumm et al. | 139/450 |

FOREIGN PATENT DOCUMENTS

| | | | |
|---|---|---|---|
| 0155431 | 9/1985 | European Pat. Off. . | |
| 0155432 | 9/1985 | European Pat. Off. . | |
| 0268550 | 1/1988 | European Pat. Off. . | |
| 0090878 | 5/1988 | European Pat. Off. . | |
| 7511117 | 3/1977 | Netherlands | 139/450 |
| 251626 | 8/1948 | Switzerland . | |
| 623865 | 6/1981 | Switzerland . | |
| 657388 | 8/1986 | Switzerland . | |

*Primary Examiner*—Andrew M. Falik

*Attorney, Agent, or Firm*—Kenyon & Kenyon

[57] ABSTRACT

An air jet loom is provided with a brake for braking a weft yarn and a set of deflectors at least one of which is movable in a controlled manner to impart tension in the weft yarn. The movement of the movable deflector can be controlled to reduce the amount of deflection during a braking operation to reduce stress peaks in the weft yarn. The movable deflector may be controlled by a spring, an electromagnet and/or a pneumatic reciprocating actuator.

11 Claims, 4 Drawing Sheets

Figure 1:
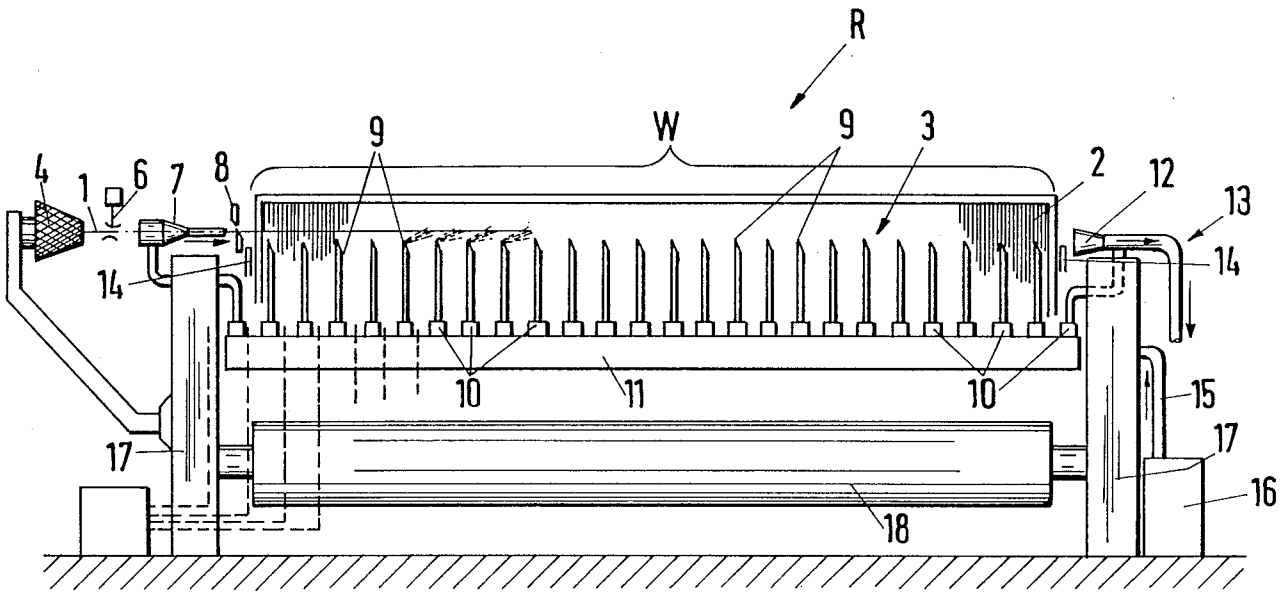

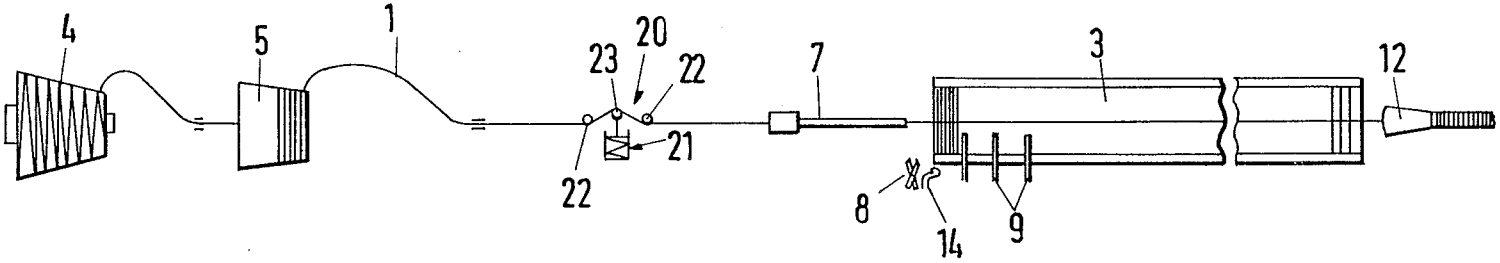
Fig. 2
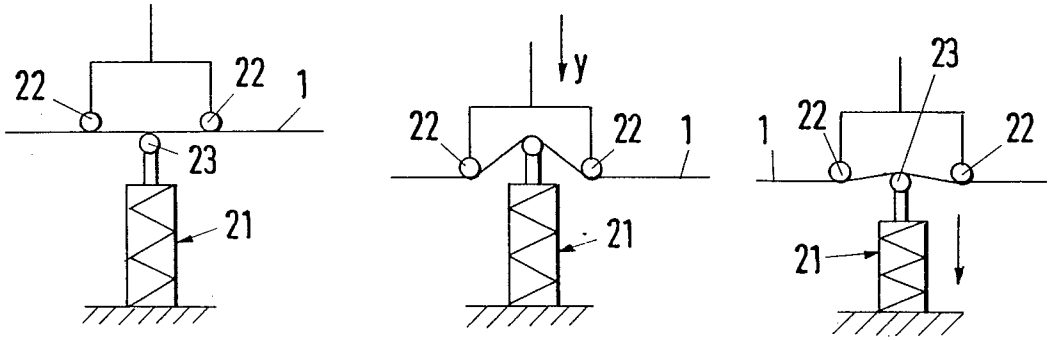
Fig. 3c
Fig. 3b
Fig. 3a

WEFT BRAKE WITH DAMPING CONTROL

This invention relates to a method and apparatus for picking a weft yarn in a loom. More particularly, this invention relates to a method and apparatus for avoiding braking stress peaks in a weft yarn during picking, particularly in an air jet loom.

As is known, yarn breakages often occur near the end of picking, particularly in air jet looms producing a substantial cloth width. These picking defects usually occur when the complete weft length has been picked and a yarn brake started; often, yarn movement is braked abruptly so that all the kinetic energy of the weft yarn is converted into tension energy thereof. The result is yarn breakages in a number varying with yarn quality.

Looms have also been known to use yarn brakes and/or yarn tensioners. With yarn brakes, the weft yarn is clamped relatively slowly between two elements which are moveable relative to one another. Stress peaks may arise if the braking is relatively abrupt, with the result of yarn breakages. The known yarn tensioners are used to keep the weft yarn stretched or to brake the yarn slightly.

For example, Swiss Patent 251,626 describes a yarn tensioner which employs one or more rods or pins to deflect a part of the yarn after braking in order to impart tension in the weft yarn prior to severing. Similar yarn tensioners are also known from Swiss Patent 623,865 and from European Patent Applications 0 090 878; 0 155 431 and0 155 432. Still other tensioners are known which employ a spring to deflect a yarn in order to impart tension therein such as described in Swiss Patent 657,388 and European Patent Application 0 268 550. However, the various types of yarn tensioners have not been able to obviate yarn breakages.

Accordingly, it is an object of the invention to obviate stress peaks in the picking of a weft yarn.

It is another object of the invention to minimize or exclude yarn breakages in the picking of weft yarns in a loom.

It is another object of the invention to provide a relatively simple technique for reducing weft yarn breakages during picking in an air jet loom.

Briefly, the invention provides a method and apparatus for picking a weft yarn in a loom such as an air jet loom in a manner to avoid stress peaks in the weft yarn.

In accordance with the method, a weft yarn is picked through a predetermined path across a shed of warp yarns and is braked at the end of the picking step. In addition, a part of the yarn is deflected from the yarn path to achieve braking and the deflection of the yarn part is then reduced in order to damp stress peaks in the yarn. In this respect, the reduction of the deflection of the yarn part serves to reduce stress peaks in the yarn. Consequently, some of the kinetic energy of the yarn is taken by deflection during braking and is taken during the damping by reducing the deflection of the yarn.

In order to perform the method, the loom is provided with a conventional picking means for picking a weft yarn through a predetermined path across a shed of warp yarns, a catching means for catching the yarn on an opposite side of the shed from the picking means and a braking means for braking the weft yarn at the end of picking. In accordance with the invention, at least two deflectors are disposed along the path of the weft yarn and a braking and damping means is located between the deflectors for deflecting a part of the yarn between the deflectors during braking of the yarn and for reducing of the deflection in order to avoid stress peaks in the yarn.

In a first embodiment, the weft yarn can be deflected from its normal path for the entire duration of picking. In this event, the continuous deflection of the weft yarn is disadvantageous because of the friction between the yarn and the yarn deflectors. Preferably, therefore, the weft yarn is deflected from its path only near the end of picking. This feature minimizes the effect on the weft yarn.

While the yarn braking means and the damping means may be separately arranged, both functions are preferably combined in a single device, the weft yarn being retarded by the braking and damping means in a predetermined deflected position, whereafter deflection decreases to obviate excessive stress peaks, in other words to damp stress peaks.

Preferably, the start, duration and/or magnitude of the deflection for braking and the reduction in deflection during damping can be adjusted or controlled. This control can be based, for example, on the measured yarn speed. Braking and damping means which are of use for performing the method hereinbefore set out can comprise force-storing means and, operatively connected thereto, a top deflector adapted to act on weft yarn movement. The force-storing means can be a spiral spring or spring strip or a corresponding spring assembly. A possible disadvantage of this embodiment is that the weft yarn is always in the deflected state so that the continuous action on picking may impair the quality of the cloth. In order to obviate this disadvantage, a deflector is provided on either side of the top deflector and is guidable on the other side thereof into the path of the weft yarn. In other words, for most of the picking movement, the weft yarn is in a linearly stretched state between the top deflector and the other deflectors. Near the end of picking, the latter deflectors move towards the weft yarn so that the top deflector also produces a deflection. Any stress peaks which arise cause an increased force to be applied to the top deflector, the increased force then being compensated for by the corresponding force-storing means.

Another form of braking and damping means is based on the solenoid principle. In this case, electromagnets move an armature into the picking path near the end of picking to deflect the weft yarn. The voltage applied to the electromagnets is so adjusted that when stress peaks occur, the weft yarn overcomes the electromagnetic force and the armature can move towards its initial position in order to avoid excessive stress peaks. Alternatively, a higher voltage can be applied initially at the start of braking, the voltage then being reduced to ensure damping.

A particularly preferred embodiment is based on a braking and damping means comprising a pneumatic reciprocating actuator having a piston with a top deflector connected to the piston, for example, by way of a piston rod. Near the end of picking, for example, the top deflector is moved very rapidly into the path of the weft yarn as a result of a work chamber of an actuator cylinder being filled while the opposing force can be controlled sensitively by way of corresponding solenoid valves.

In this latter embodiment, the braking and damping means can also be used very satisfactorily as a yarn brake. In this event, a resilient abutment is associated with the top deflector. In an end position, the top deflector engages the weft yarn on the resilient abutment so that the weft yarn is clamped between the abutment and the top deflector. If the air pressure in the cylinder is then reduced, the top deflector can return in response to a stress peak against the pressure of the air in the cylinder chamber, the reciprocating actuator being effective for damping.

Other embodiments of the braking and damping means themselves are possible It has been found in practice that the damping means according to this invention can reduce yarn breakages by approximately 40 percent.

Figure 4:
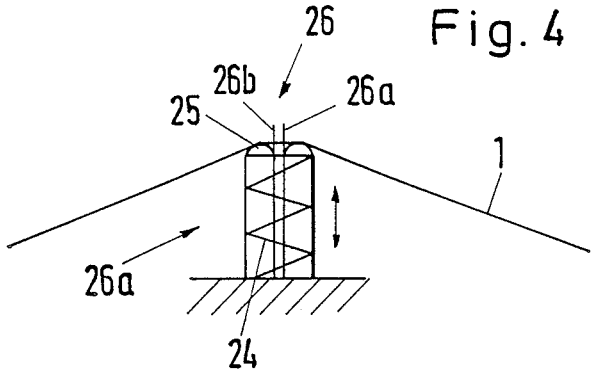
Figure 5:
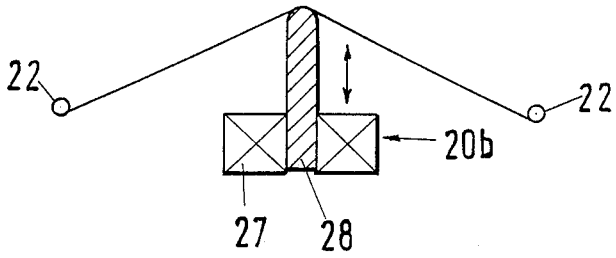
Figure 6:
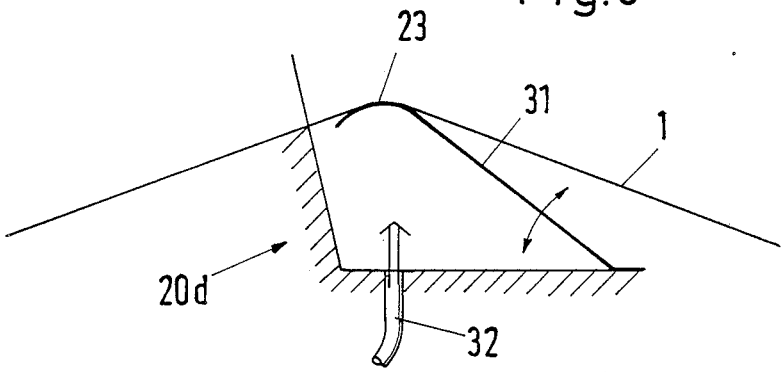
Figure 7:
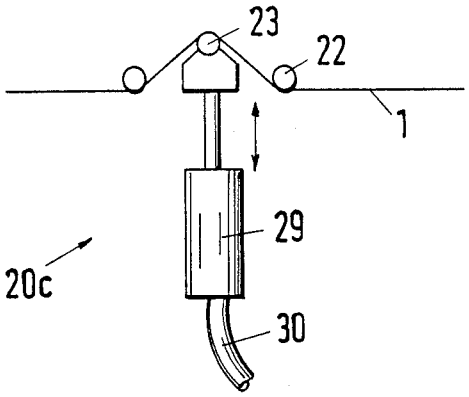
Figure 8:
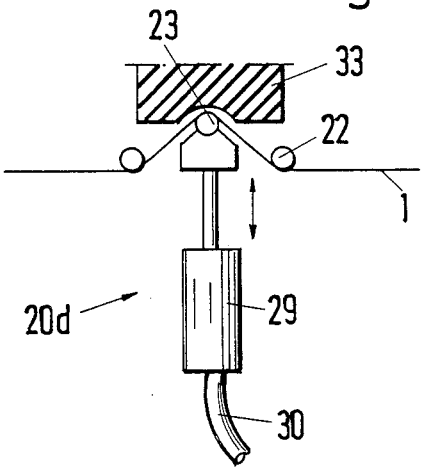
Figure 9:
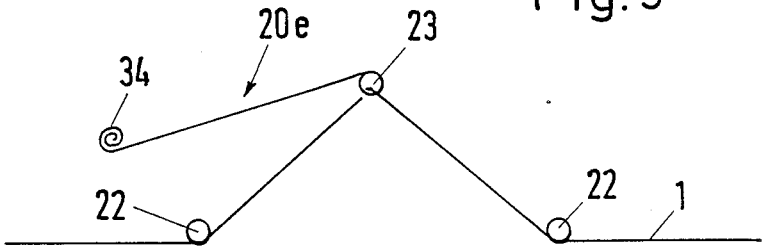

These and other objects and advantages of the invention will become more apparent from the following detailed description taken in conjunction with the accompany drawings wherein:

FIG. 1 diagrammatically illustrates a front elevation of an air jet loom;

FIG. 2 illustrates a simplified diagrammatic view of an air jet loom employing a damping means in accordance with the invention;

FIGS. 3A, 3B and 3C diagrammatically illustrates a sequence of movements of the damping means for damping a weft yarn in accordance with the invention, and FIG. 4 diagrammatically illustrates a force-storing means in the form of a simple compression string element;

FIG. 5 diagrammatically illustrates a force-storing means in the form of an electromagnet;

FIG. 6 diagrammatically illustrates a force-storing means in the form of a spring strip in accordance with the invention;

FIG. 7 diagrammatically illustrates a braking means utilizing a pneumatic reciprocating actuator in accordance with the invention;

FIG. 8 illustrates a view similar to FIG. 7 of a braking and damping means which employs a resilient abutment in combination with a pneumatic reciprocating actuator in accordance with the invention; and FIG. 9 illustrates a view of a braking and damping means employing a spring in accordance with the invention.

Referring to FIG. 1, in an air jet loom R, a weft yarn 1 is drawn off a package 4 which is non-displaceably mounted outside a shed 3 formed by warp yarns 2. The weft yarn 1 goes first to a drum type yarn storage device 5 shown in FIg. 2, then through a yarn brake 6 and therefrom to a picking means including main picking nozzle 7.

The nozzle 7 injects the weft yarn 7 past shears 8 into a shed 3 of predetermined cloth width W. During picking through the shed 3, the weft yarn 1 is assisted by relay nozzles 9 connected by way of solenoid valves 10 to a compressed air line or tube 11.

After the tip of the weft yarn 1 has issued from the shed 3, the yarn 1 enters a funnel 12 of an extractor 13 and is severed, the yarn ends being laid by respective selvedge levers 14 into the edge zone of cloth width.

A lateral compressed air line 15 for connecting the tube 11 to an air compressor unit 16 is also provided. The loom R has side walls 17 and a cloth beam 18 mounted across the walls 17.

As can be seen in FIg. 2, the main picking nozzle 7 is preceded by a braking and damping means 20 basically comprised of a force-storing means 21 for deflecting the weft yarn 1 from its linear path. The deflection is produced, inter alia, by means of two deflectors 22 disposed one on either side of the force-storing means 21. The force-storing means 21 cooperates with a third deflector 23 to engage the weft yarn 1 substantially centrally between the two deflectors 22.

FIGS. 3A, 3B and 3C shows a possible variation of the method in which all the deflectors 22, 23 are displaceable relative to the path of the weft yarn 1.

FIG. 3A shows the arrangement of the force-storing means 21 and deflectors 22, 23 occurring during picking. Near the end of picking, the deflectors 22 descent in the direction indicated by an arrow in FIG. 3B, so that the weft yarn 1 is deflected from its path downwardly and over the deflector 23. The force-strong means 21 is adapted to yield with a delay up to the force exerted by the deflection of the yarn 1 on the top deflector 23, as is shown in FIG. 3C. The yielding can proceed to an extent such that the weft yarn 1 returns substantially to its straight path.

In the embodiments shown in FIGS. 4 to 9, the deflectors 22 can be non-displaceable whereas the force-storing means 21 are so devised that the top deflector 23 is extended near the end of picking and deflects the weft yarn 1 from its path. Thereafter, the force of the means 21 is reduced so that the top deflector 23 is returned to its initial position by the pull of the weft yarn 1 in accordance with such reduction.

Referring to FIG. 4, the braking and damping means 26*a* comprises a compression spring 24 having a cup 25 or the like on the top to protect the yarn 1. A yarn guide 26 is also provided to guide the yarn between two guide members 26*a*, 26*b*.The braking and damping means 26*a* is light in weight, has an appropriate spring rate and has an adequately high natural frequency to return to the initial position in good time after deflection. The braking and damping means 26*a* is a very simple means of reducing stress peaks in the yarn although, since the weft yarn experiences permanent deflection by the compression spring 24, yarn quality may sometimes by impaired during picking. Because of this disadvantage, braking and damping means with an on-off control or, even better, a continuously variable control are preferred which engage the weft yarn 1 only for the time actually required.

For this reason, in the embodiment shown in FIG. 5, a light solenoid replaces the compression spring. The solenoid includes an electromagnet 27 which is non-displaceable and an armature 28 which can move in the direction indicated by the arrows. When the electromagnetic 27 is used, the armature 28 can be moved under electromagnetic control into the path of the yarn where the armature 28 is then effective as a combined braking and damping element. To ensure vibration-free deflection, the yarn can be deflected on to an abutment in a manner to be described hereinafter.

Referring to FIG. 7 the braking and damping means 20*c* is in the form of a pneumatic reciprocating actuator 29 for moving a top deflector 23 in the direction indicated by the arrow. By way of a compressed air connection 30, the actuator 29 communicates with an appropriate compressed air supply (not shown). The use of a pneumatic reciprocating actuator 29 permits the different parameters affecting the combined braking and damping element to be varied in a relatively simple manner. The adjustment can be made directly at the loom terminal by appropriate actuation by means of a solenoid valve similar to that of a relay nozzle valve 10.

Increasing the pressure increases the speed of piston movement and simultaneously reduces damping. This may often not be desirable. First, accurate and rapid engagement is preferred and to assist variability should have a very short reaction time. Second, a reduced spring rate is desirable. Both requirements can be satisfied if the deflection and damping functions are separated in the manner shown in FIGS. 3A, 3B and 3C. As previously stated, the braking and damping function can be provided by a simple compression spring element of the kind shown in FIG. 4. If required, the compression spring 24 could be slightly prestressed with an abutment to improve behavior at the start and end of engagement. Engagement by the deflectors 22 is produced, for example, by a linear motor, so fast that the compression spring 24 is compressed only in response to the occurrence of a yarn stress peak and not prematurely. The stress peak can then be better reduced since the reduced spring rate of the spring 24 and the complete deflection movement of the web yarn 1 increase the damping effect.

The embodiment of braking and damping means 20*d* shown in FIG. 6 corresponds more to the embodiment of FIG. 4. During picking, a spring strip 31 deflects the weft yarn 1. When yarn tension rises at the end of picking, the spring strip 31 is pressed back. An air flow from a compressed air connection 32 acts on the spring strip 31 and boosts the spring effect of the spring 31 to varying extents so that the timing of braking and damping can be varied in dependence on air pressure.

Referring to FIG. 8, a resilient abutment 33 may be engaged by the top deflector 23 in the extended state so as to clamp a weft yarn 1 therebetween so that the braking effect can be increased. The resilient abutment 23 may also be used with the solenoid type braking and damping means 20*b* of FIG. 5 to obviate chatter in the end position.

All the deflectors 22, 23 should be made of a material having a low coefficient of friction, such as sapphire glass or the like.

FIG. 9 shows another simple embodiment of braking and damping means 20*e* corresponding to those shown in FIG. 4, except that the spring is not a compression spring but a spring strip with an attached spiral spring 34.

The invention thus provides a method and apparatus for picking a weft yarn in a loom such as an air jet loom in a manner to reduce stress peaks during braking and tensioning.

What is claimed is:

1. A method of picking a weft yarn in a loom comprising the steps of picking a weft yarn through a predetermined path across a shed of warp yarns;

deflecting the weft yarn during the end of said picking step to brake the yarn; and thereafter reducing the deflection of the yarn part to avoid excessive stress peaks in the yarn during braking.

2. In a loom, the combination of a picking means for picking a weft yarn through a predetermined path across a shed of warp yarns;

a catching means for catching the yarn on an opposite side of the shed from said picking means;

a braking means for braking the weft yarn at the end of picking;

at least two deflectors disposed along the path of the weft yarn; and a damping means between said deflectors for imparting a force on the yarn for deflecting a part of the yarn between said deflectors during braking of the yarn, said damping means being yieldable in a direction opposite the direction of said force to avoid stress peaks in the yarn during braking.

3. A combination as set forth in claim 2 wherein said damping means includes force-storing means and a deflector connected thereto for engaging a yarn.

4. A combination as set forth in claim 3 wherein said force-storing means is a spring.

5. A combination as set forth in claim 4 wherein said two deflectors are movable in a controlled manner into said yarn path relative to said third deflector.

6. A combination as set forth in claim 2 wherein said damping means includes an electromagnet having an armature for controlled movement towards said two deflectors.

7. A combination as set forth in claim 2 wherein said damping means is a pneumatic reciprocating actuator having a piston and a third deflector connected to said piston for movement between said two deflectors.

8. A combination as set forth in claim 2 which further comprises a resilient abutment opposite said damping means relative to the yarn path for clamping the yarn therebetween.

9. In a loom, the combination of a picking means for picking a weft yarn through a predetermined path across a shed of warp yarns;

a catching means for catching the yarn on an opposite side of the shed from said picking means;

a braking means for braking the weft yarn at the end of picking;

at least two deflectors disposed along the path of the weft yarn; and a damping means between said deflectors for deflecting a part of the yarn between said deflectors during braking of the yarn to avoid stress peaks in the yarn, said damping means including a spring and a deflector connected to said spring for engaging a yarn.

10. A loom as set forth in claim 9 wherein said damping means is a pneumatic reciprocating actuator having a piston and a third deflector connected to said piston for movement between said two deflectors.

11. A loom as set forth in claim 9 which further comprises a resilient abutment opposite said damping means relative to the yarn path for clamping the yarn therebetween.

* * * * *

UNITED STATES PATENT AND TRADEMARK OFFICE

CERTIFICATE OF CORRECTION

PATENT NO. : 4,962,796

DATED : October 16, 1990

INVENTOR(S) : PETER GRIMM, et al

It is certified that error appears in the above-identified patent and that said Letters Patent is hereby corrected as shown below:

Column 1, line 32 change "andO" to -and O-
Column 3, line 10 change "possible It" to -possible. It-
Column 3, line 35 change "braking means" to -braking and damping means-
Column 3, line 65 change "FIg." to -FIG.-
Column 4, line 10 change "descent" to -descend-
Column 4, line 40 change "by" to -be-
Column 4, line 51 change "magnetic" to -magnet-
Column 6, line 17 change "force" to -a force-
Column 6, line 21 change "4" to -9-

Signed and Sealed this

Seventh Day of July, 1992

*Attest:*

DOUGLAS B. COMER

*Attesting Officer*

*Acting Commissioner of Patents and Trademarks*